US011189228B2

(12) United States Patent
Li et al.

(10) Patent No.: US 11,189,228 B2
(45) Date of Patent: Nov. 30, 2021

(54) PIXEL CIRCUIT, METHOD FOR DRIVING PIXEL CIRCUIT, AND DISPLAY DEVICE

(71) Applicant: BOE Technology Group Co., Ltd., Beijing (CN)

(72) Inventors: Quanhu Li, Beijing (CN); Yongfu Diao, Beijing (CN); Wenkang Wang, Beijing (CN); Zhongliu Yang, Beijing (CN); Mingjing Yang, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/630,305

(22) PCT Filed: Jun. 5, 2019

(86) PCT No.: PCT/CN2019/090148
§ 371 (c)(1),
(2) Date: Jan. 10, 2020

(87) PCT Pub. No.: WO2020/052287
PCT Pub. Date: Mar. 19, 2020

(65) Prior Publication Data

US 2021/0065624 A1 Mar. 4, 2021

(30) Foreign Application Priority Data

Sep. 13, 2018 (CN) ..... 201811069681.1

(51) Int. Cl.
*G09G 3/3258* (2016.01)
*G09G 3/3291* (2016.01)

(52) U.S. Cl.
CPC ..... *G09G 3/3258* (2013.01); *G09G 3/3291* (2013.01); *G09G 2310/0272* (2013.01)

(58) Field of Classification Search
None
See application file for complete search history.

(56) References Cited

U.S. PATENT DOCUMENTS 8,866,705 B2 10/2014 Takasugi et al.
9,123,294 B2 9/2015 Han et al.
(Continued)

FOREIGN PATENT DOCUMENTS

CN 102254510 A 11/2011
CN 102956192 A 3/2013
(Continued)

OTHER PUBLICATIONS

Sep. 1, 2020—(CN) First Office Action Appn 201811069681.1 with English Translation.

*Primary Examiner* — Ifedayo B Iluyomade
(74) *Attorney, Agent, or Firm* — Banner & Witcoff, Ltd.

(57) ABSTRACT

A pixel circuit, a method for driving a pixel circuit, and a display device are provided. The pixel circuit includes: a storage circuit, a data writing circuit, a light emitting driving circuit, and a compensation circuit. The data writing circuit is configured to write a data voltage to the storage circuit under control of a scanning control signal; the storage circuit is configured to store the data voltage and enable a stored data voltage to be available to the compensation circuit for a compensation operation; the compensation circuit is configured to maintain a compensation voltage based on the stored data voltage at a control terminal of the light emitting driving circuit under control of a compensation control signal; and the light emitting driving circuit configured to drive the light emitting element to emit light under control of the compensation voltage.

19 Claims, 5 Drawing Sheets

(56) References Cited

U.S. PATENT DOCUMENTS

| | | | | |
|---|---|---|---|---|
| 9,666,125 | B2 | 5/2017 | Chung | |
| 2009/0243977 | A1 | 10/2009 | Chung | |
| 2011/0157125 | A1 | 6/2011 | Choi | |
| 2014/0192038 | A1 | 7/2014 | Qin et al. | |
| 2016/0321997 | A1* | 11/2016 | Jeong | H01L 29/78696 |
| 2017/0053595 | A1 | 2/2017 | Liu et al. | |

FOREIGN PATENT DOCUMENTS

| | | | | | |
|---|---|---|---|---|---|
| CN | 103077680 | A | | 5/2013 | |
| CN | 103778889 | A | | 5/2014 | |
| CN | 104778915 | A | | 7/2015 | |
| CN | 105427803 | A | | 3/2016 | |
| CN | 107424563 | A | | 12/2017 | |
| CN | 108257552 | A | | 7/2018 | |
| CN | 108389551 | | * | 8/2018 | G09G 3/3258 |
| CN | 108389551 | A | | 8/2018 | |
| KR | 20180078861 | A | | 7/2018 | |

* cited by examiner

PIXEL CIRCUIT, METHOD FOR DRIVING PIXEL CIRCUIT, AND DISPLAY DEVICE

The application is a U.S. National Phase Entry of International Application No. PCT/CN2019/090148 filed on Jun. 5, 2019, designating the United States of America and claiming priority to Chinese Patent Application No. 201811069681.1, filed on Sep. 13, 2018. The present application claims priority to and the benefit of the above-identified applications and the above-identified applications are incorporated by reference herein in their entirety.

TECHNICAL FIELD

Embodiments of the present disclosure relate to a pixel circuit, a method for driving a pixel circuit, and a display device.

BACKGROUND

Organic light emitting diode (OLED) display panels have characteristics such as self-luminous, high contrast ratio, low energy consumption, wide viewing angle, fast response speed, capable of being used in flexible panels, wide temperature range, simple manufacturing process, etc., and have broad development prospects. With the rapid development of OLED display panels, OLED display panels need to possess characteristics of high resolution and high refresh rate.

SUMMARY

At least some embodiments of the present disclosure provide a pixel circuit, which comprises a storage circuit, a data writing circuit, a light emitting driving circuit, and a compensation circuit. The data writing circuit is connected to the storage circuit, and is configured to write a data voltage to the storage circuit under control of a scanning control signal; the storage circuit is configured to store the data voltage and enable a stored data voltage to be available to the compensation circuit for a compensation operation; the compensation circuit is connected to the light emitting driving circuit, and is configured to maintain a compensation voltage based on the stored data voltage at a control terminal of the light emitting driving circuit under control of a compensation control signal; and the light emitting driving circuit is further connected to a light emitting element, and is configured to drive the light emitting element to emit light under control of the compensation voltage.

For example, in the pixel circuit provided by some embodiments of the present disclosure, the storage circuit comprises a first capacitor, a first terminal of the first capacitor is connected to a first power supply terminal, and a second terminal of the first capacitor is connected to the data writing circuit.

For example, in the pixel circuit provided by some embodiments of the present disclosure, the light emitting driving circuit comprises a driving transistor. The control terminal of the light emitting driving circuit comprises a control electrode of the driving transistor, a first electrode of the driving transistor is connected to the data writing circuit and the second terminal of the first capacitor, and a second electrode of the driving transistor and the control electrode of the driving transistor are both connected to the compensation circuit.

For example, in the pixel circuit provided by some embodiments of the present disclosure, the data writing circuit comprises a data writing transistor. A first electrode of the data writing transistor is configured to receive the data voltage, a second electrode of the data writing transistor is connected to the second terminal of the first capacitor and the first electrode of the driving transistor, and a control electrode of the data writing transistor is configured to receive the scanning control signal.

For example, in the pixel circuit provided by some embodiments of the present disclosure, the compensation circuit comprises a compensation transistor and a second capacitor. A first electrode of the compensation transistor is connected to the second electrode of the driving transistor, a second electrode of the compensation transistor is connected to the control electrode of the driving transistor, and a control electrode of the compensation transistor is configured to receive the compensation control signal; a first terminal of the second capacitor is connected to a second power supply terminal, and a second terminal of the second capacitor is connected to the control electrode of the driving transistor; and a capacitance value of the first capacitor is greater than a capacitance value of the second capacitor.

For example, the pixel circuit provided by some embodiments of the present disclosure further comprises a light emitting control circuit. The light emitting control circuit is connected to the light emitting driving circuit and the light emitting element, respectively, and is configured to control the light emitting driving circuit to drive the light emitting element to emit light under control of a light emitting control signal.

For example, in the pixel circuit provided by some embodiments of the present disclosure, the light emitting control circuit comprises a first light emitting control transistor, and the light emitting control signal comprises a first light emitting control sub-signal. A first electrode of the first light emitting control transistor is connected to the second power supply terminal, a second electrode of the first light emitting control transistor is connected to the first electrode of the driving transistor, and a control electrode of the first light emitting control transistor is configured to receive the first light emitting control sub-signal.

For example, in the pixel circuit provided by some embodiments of the present disclosure, a first voltage signal output from the first power supply terminal and a second voltage signal output from the second power supply terminal are identical.

For example, in the pixel circuit provided by some embodiments of the present disclosure, the light emitting control circuit further comprises a second light emitting control transistor, and the light emitting control signal comprises a second light emitting control sub-signal. A first electrode of the second light emitting control transistor is connected to the second electrode of the driving transistor, a second electrode of the second light emitting control transistor is connected to a first terminal of the light emitting element, a control electrode of the second light emitting control transistor is configured to receive the second light emitting control sub-signal, and a second terminal of the light emitting element is connected to a third power supply terminal.

For example, in the pixel circuit provided by some embodiments of the present disclosure, a first voltage signal output from the first power supply terminal and a third voltage signal output from the third power supply terminal are identical.

For example, the pixel circuit provided by some embodiments of the present disclosure further comprises a first reset circuit. The first reset circuit is connected to the control terminal of the light emitting driving circuit and a reset signal terminal, and is configured to reset the control terminal of the light emitting driving circuit under control of a first reset control signal.

For example, the pixel circuit provided by some embodiments of the present disclosure further comprises a second reset circuit. The second reset circuit is connected to a first terminal of the light emitting element and a reset signal terminal, and is configured to reset the first terminal of the light emitting element under control of a second reset control signal.

For example, in the pixel circuit provided by some embodiments of the present disclosure, the compensation control signal and the second reset control signal are a same signal.

For example, in the pixel circuit provided by some embodiments of the present disclosure, a first voltage signal output from the first power supply terminal and a reset signal output from the reset signal terminal are identical.

At least some embodiments of the present disclosure further provide a pixel circuit, which comprises a first capacitor, a second capacitor, a driving transistor, a data writing transistor, a compensation transistor, a first light emitting control transistor, a second light emitting control transistor, a first reset transistor, and a second reset transistor. A first electrode of the data writing transistor is configured to receive a data voltage, a second electrode of the data writing transistor is connected to a second terminal of the first capacitor, and a control electrode of the data writing transistor is configured to receive a scanning control signal; a first terminal of the first capacitor is connected to a first power supply terminal, and the first capacitor is configured to store the data voltage written by the data writing transistor; a first electrode of the driving transistor is connected to the second electrode of the data writing transistor and the second terminal of the first capacitor, a second electrode of the driving transistor is connected to a first electrode of the compensation transistor, and a control electrode of the driving transistor is connected to a second electrode of the compensation transistor; a control electrode of the compensation transistor is configured to receive a compensation control signal; a first terminal of the second capacitor is connected to the first power supply terminal, and a second terminal of the second capacitor is connected to the control electrode of the driving transistor; a first electrode of the first light emitting control transistor is connected to the first power supply terminal, a second electrode of the first light emitting control transistor is connected to the first electrode of the driving transistor, and a control electrode of the first light emitting control transistor is configured to receive a first light emitting control sub-signal; a first electrode of the second light emitting control transistor is connected to the second electrode of the driving transistor, a second electrode of the second light emitting control transistor is connected to a first terminal of a light emitting element, and a control electrode of the second light emitting control transistor is configured to receive the first light emitting control sub-signal; a second terminal of the light emitting element is connected to a third power supply terminal; a first electrode of the first reset transistor is connected to a reset signal terminal, a second electrode of the first reset transistor is connected to the control electrode of the driving transistor, and a control electrode of the first reset transistor is configured to receive a first reset control signal; and a first electrode of the second reset transistor is connected to the reset signal terminal, a second electrode of the second reset transistor is connected to the first terminal of the light emitting element, and a control electrode of the second reset transistor is configured to receive a second reset control signal.

At least some embodiments of the present disclosure further provide a method for driving the pixel circuit according to any one of the embodiments of the present disclosure. The method comprises: in a data writing phase, writing the data voltage to the storage circuit; in a compensation phase, writing the compensation voltage to the compensation circuit according to the stored data voltage; and in a light emitting phase, driving the light emitting element to emit light based on the compensation voltage.

For example, in the method provided by some embodiments of the present disclosure, a duration of the data writing phase is shorter than a duration of the compensation phase.

At least some embodiments of the present disclosure further provide a display device, which comprises the pixel circuit according to any one of the embodiments of the present disclosure.

For example, the display device provided by some embodiments of the present disclosure further comprises the light emitting element according to any one of the embodiments of the present disclosure. The pixel circuit is configured to drive the light emitting element to emit light.

BRIEF DESCRIPTION OF THE DRAWINGS

In order to clearly illustrate the technical solutions of the embodiments of the disclosure, the drawings of the embodiments will be briefly described in the following; it is obvious that the described drawings are only related to some embodiments of the disclosure and thus are not limitative to the disclosure.

DETAILED DESCRIPTION

Figure 1:
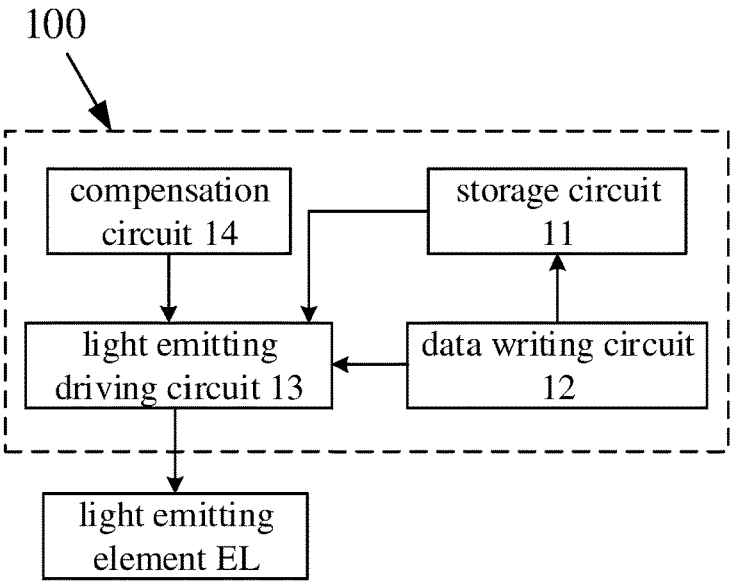
FIG. 1 is a schematic block diagram of a pixel circuit provided by some embodiments of the present disclosure.

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. Also, the terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

To make the following description of the embodiments of the present disclosure clear and concise, the present disclosure omits detailed descriptions of known functions and known components.

Currently, there are some problems with OLED displays having high refresh rates. For example, for an electronic product (e.g., a notebook computer) with a resolution of 2400 (RGB)×1600 and a frequency of 120 HZ, the time for writing one row of data is only about 5 microseconds. Due to the large load of a pixel circuit of the electronic product, the rise time of a gate voltage of a driving transistor in the pixel circuit is relatively long, which results in insufficient compensation for the pixel circuit, and the phenomenon of non-uniformity of the brightness of the display panel occurs, which further affects the display effect of the display panel.

At least one embodiment of the present disclosure provides a pixel circuit, a method for driving a pixel circuit, and a display device. By temporarily storing a data voltage through a storage circuit, a compensation operation can still be performed after a data writing phase. The compensation time is extended to achieve the purpose of sufficient compensation, and the compensation time is independent of the refresh rate and resolution of the display panel, thereby improving the uniformity of the display brightness of the display panel and improving the display effect.

For example, according to the characteristics of transistors, the transistors can be divided into N-type transistors and P-type transistors. For the sake of clarity, the embodiments of the present disclosure take a case that the transistors are P-type transistors (for example, low-temperature polysilicon (LTPS) P-type thin film transistors) as an example to explain the technical solutions of the present disclosure. However, the transistors of the embodiments of the present disclosure are not limited to P-type transistors, and those skilled in the art can also use N-type transistors (for example, N-type MOS transistors) to implement the function of one or more transistors in the embodiments of the present disclosure according to actual needs.

It should be noted that the transistors used in the embodiments of the present disclosure may be thin film transistors, field effect transistors, or other switching devices having the same characteristics. The thin film transistors may include oxide semiconductor thin film transistors, amorphous silicon thin film transistors, polysilicon thin film transistors, or the like. The source electrode and the drain electrode of the transistor may be symmetrical in structure, so the source electrode and the drain electrode of the transistor may be indistinguishable in structure. In the embodiments of the present disclosure, in order to distinguish two electrodes of the transistor except the gate electrode which serves as a control electrode, one of the two electrodes is described as a first electrode directly, and the other of the two electrodes is described as a second electrode. Therefore, the first electrode and the second electrode of all or part of the transistors in the embodiments of the present disclosure can be interchanged as needed.

Several embodiments of the present disclosure are described in detail below with reference to the drawings, but the present disclosure is not limited to these specific embodiments.

Figure 2A:
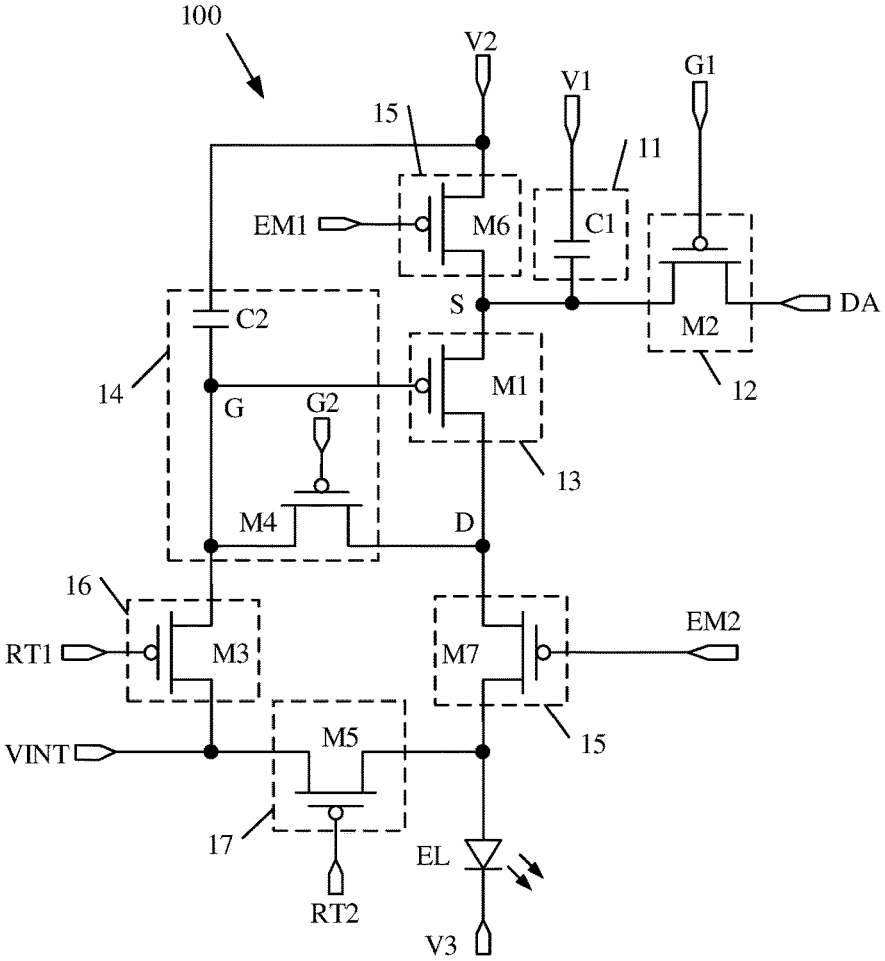
FIG. 2A is a structural diagram of a pixel circuit provided by some embodiments of the present disclosure.

FIG. 1 is a schematic block diagram of a pixel circuit provided by some embodiments of the present disclosure, and FIG. 2A is a structural diagram of a pixel circuit provided by some embodiments of the present disclosure.

For example, as illustrated in FIG. 1, a pixel circuit 100 provided by some embodiments of the present disclosure may comprise a storage circuit 11, a data writing circuit 12, a light emitting driving circuit 13, and a compensation circuit 14. For example, the data writing circuit 12 is connected to the storage circuit 11 and the light emitting driving circuit 13, respectively, and is configured to write a data voltage to the storage circuit 11 under control of a scanning control signal. The storage circuit 11 is connected to the light emitting driving circuit 13, and is further connected to the compensation circuit 14 through the light emitting driving circuit 13, so that the storage circuit 11 is configured to store the data voltage and enable a stored data voltage to be available to the compensation circuit 14 for a compensation operation. The compensation circuit 14 is connected to the light emitting driving circuit 13, and is configured to maintain a compensation voltage based on the stored data voltage at a control terminal of the light emitting driving circuit 13 under control of a compensation control signal, that is, the compensation circuit 14 may determine the compensation voltage based on the stored data voltage under control of the compensation control signal, and maintain the compensation voltage at the control terminal of the light emitting driving circuit 13. The light emitting driving circuit 13 is further connected to a light emitting element EL, and is configured to drive the light emitting element EL to emit light under control of the compensation voltage.

For example, the stored data voltage stored in the storage circuit 11 and the data voltage received by the data writing circuit 12 may be different. For example, due to the influences of factors such as voltage drops on signal lines during transmission, the value of the stored data voltage stored in the storage circuit 11 may be smaller than the value of the data voltage received by the data writing circuit 12.

For example, the pixel circuit 100 may be applied to a display panel, such as an active matrix organic light emitting diode (AMOLED) display panel, and the like. The AMOLED display panel includes the pixel circuit 100 provided by the embodiments of the present disclosure, so that the AMOLED display panel can have characteristics such as high refresh rate, high resolution, good brightness uniformity, medium and large size, and the like.

For example, the light emitting element EL is configured to receive a light emitting signal (e.g., may be a current signal) during operation and emit light of an intensity corresponding to the light emitting signal. The light emitting element EL may be a light emitting diode, and the light emitting diode may be, for example, an organic light emitting diode (OLED), a quantum dot light emitting diode (QLED), or the like, but the embodiments of the present disclosure are not limited thereto. The light emitting element EL can use, for example, different light emitting materials to emit light of different colors, thereby performing color light emission.

For example, as illustrated in FIG. 2A, the storage circuit 11 comprises a first capacitor C1. A first terminal of the first capacitor C1 is connected to a first power supply terminal V1, a second terminal of the first capacitor C1 is connected to a first node S, and the data writing circuit 12 is also connected to the first node S, that is, the second terminal of the first capacitor C1 is connected to the data writing circuit 12.

For example, the first power supply terminal V1 is a DC reference voltage terminal to output a constant DC reference voltage. The first power supply terminal V1 may be a high voltage terminal or a low voltage terminal, as long as the first power supply terminal V1 can provide the constant DC reference voltage, which is not limited in the present disclosure. For example, in some examples, the first power supply terminal V1 may be grounded.

For example, as illustrated in FIG. 2A, the light emitting driving circuit 13 comprises a driving transistor M1, and the control terminal of the light emitting driving circuit 13 comprises a control electrode of the driving transistor M1. A first electrode of the driving transistor M1 is connected to the first node S, that is, the first electrode of the driving transistor M1 is connected to the data writing circuit 12 and the second terminal of the first capacitor C1. A second electrode of the driving transistor M1 and the control electrode of the driving transistor M1 are both connected to the compensation circuit 14. As illustrated in FIG. 2A, the second electrode of the driving transistor M1 is connected to a second node D, and the control electrode of the driving transistor M1 is connected to a third node G.

For example, the driving transistor M1 is a P-type transistor, the first electrode of the driving transistor M1 is a source electrode, and the second electrode of the driving transistor M1 is a drain electrode, which is described below as an example, but the embodiments of the present disclosure are not limited thereto.

For example, as illustrated in FIG. 2A, the data writing circuit 12 comprises a data writing transistor M2. A first electrode of the data writing transistor M2 is configured to receive a data voltage $V_{data1}$, a second electrode of the data writing transistor M2 is connected to the first node S, that is, the second electrode of the data writing transistor M2 is connected to the second terminal of the first capacitor C1 and the first electrode of the driving transistor M1, and a control electrode of the data writing transistor M2 is configured to receive a scanning control signal VG1. For example, the first electrode of the data writing transistor M2 is connected to a data line DA to receive the data voltage $V_{data1}$; and the control electrode of the data writing transistor M2 is connected to a gate line G1 to receive the scanning control signal VG1.

For example, as illustrated in FIG. 2A, the compensation circuit 14 may comprise a compensation transistor M4 and a second capacitor C2. A first electrode of the compensation transistor M4 is connected to the second node D, that is, the first electrode of the compensation transistor M4 is connected to the second electrode of the driving transistor M1, a second electrode of the compensation transistor M4 is connected to the third node G, that is, the second electrode of the compensation transistor M4 is connected to the control electrode of the driving transistor M1, and a control electrode of the compensation transistor M4 is configured to receive a compensation control signal VG2. For example, the control electrode of the compensation transistor M4 is configured to be connected to a compensation control signal line G2 to receive the compensation control signal VG2. A first terminal of the second capacitor C2 is connected to a second power supply terminal V2, and a second terminal of the second capacitor C2 is connected to the third node G, that is, the second terminal of the second capacitor C2 is connected to the control electrode of the driving transistor M1.

For example, a capacitance value of the first capacitor C1 is larger than a capacitance value of the second capacitor C2, so as to ensure that the reduction amount of the voltage of the first node S is small during a compensation process. For example, the capacitance value of the first capacitor C1 may be multiple times of the capacitance value of the second capacitor C2, such as 50~1000 times, and for example 200~500 times, so that the capacitance value of the first capacitor C1 is much larger than the capacitance value of the second capacitor C2.

For example, the scanning control signal VG1 and the compensation control signal VG2 are different, so that the data writing transistor M2 and the compensation transistor M4 can be controlled separately. For example, the valid time of the scanning control signal VG1 is shorter than the valid time of the compensation control signal VG2, that is, the time during which the data writing transistor M2 is turned on is shorter than the time during which the compensation transistor M4 is turned on. For example, the compensation control signal VG2 may be any signal, and the signal is valid in a period during which the data writing transistor M2 is turned on and in a period after the data writing transistor M2 is turned off.

For example, the second power supply terminal V2 may also be a DC voltage terminal to output a constant DC voltage. The second power supply terminal V2 may be a high voltage terminal.

For example, a first voltage signal output from the first power supply terminal V1 and a second voltage signal output from the second power supply terminal V2 may be identical. For example, the first power supply terminal V1 and the second power supply terminal V2 may be a same power supply terminal, so as to decrease the number of power supply terminals in the pixel circuit and save production costs.

It should be noted that the first voltage signal output from the first power supply terminal V1 and the second voltage signal output from the second power supply terminal V2 may also be different, which is not limited in the present disclosure.

For example, in a data writing phase, the control electrode of the data writing transistor M2 can receive the scanning control signal VG1 which is valid (e.g., a low level signal), so that the data writing transistor M2 is turned on. The control electrode of the compensation transistor M4 can receive the compensation control signal VG2 which is valid (e.g., a low level signal), so that the compensation transistor M4 is turned on. Because the data writing transistor M2 is turned on, the data voltage $V_{data1}$ can be written into the first capacitor C1 via the data writing transistor M2. Because the compensation transistor M4 is also turned on, the control electrode of the driving transistor M1 and the second electrode of the driving transistor M1 are electrically connected, so that the driving transistor M1 is in a diode connection state and is in a saturation state. The data voltage $V_{data1}$ can be written into the second capacitor C2 via the driving transistor M1 and the compensation transistor M4 successively.

For example, in a compensation phase, the scanning control signal VG1 becomes an invalid signal (e.g., a high level signal), that is, the data writing transistor M2 is turned off. The compensation control signal VG2 is still a valid signal (i.e., the compensation control signal VG2 is still a low level signal), so that the compensation transistor M4 is still turned on. Because the first capacitor C1 can store the stored data voltage $V_{data2}$, at this time, a voltage at the first node S is still the stored data voltage $V_{data2}$. Therefore, the stored data voltage $V_{data2}$ can still be written into the second capacitor C2 through the driving transistor M1 and the compensation transistor M4 successively, so as to implement the compensation operation. In the compensation phase, the voltage of the first node S gradually decreases and a voltage of the third node G gradually increases. In a case where a voltage difference $V_{GS}$ between the third node G and the first node S is equal to a threshold voltage Vth of the driving transistor M1, that is, $V_{GS}$=Vth, the driving transistor M1 is turned off, and the compensation phase ends.

For example, because the capacitance value of the first capacitor C1 is much larger than the capacitance value of the second capacitor C2, the reduction amount of the voltage of the first node S is small during the compensation process. Therefore, at the end of the compensation phase, the voltage of the first node S is basically the same as the stored data voltage $V_{data2}$. That is, at the end of the compensation phase, the voltage of the first node S is about the stored data voltage $V_{data2}$, and a voltage of the third node G is about $V_{data2}$+Vth. For example, the compensation voltage is the voltage at the third node G at the end of the compensation phase, that is, the compensation voltage is $V_{data2}$+Vth. It should be noted that in a case where the influence of the factors such as the voltage drop on the signal lines during transmission is not considered, the value of the stored data voltage stored on the storage circuit 11 can be considered to be equal to the value of the data voltage received by the data writing circuit 12, that is, $V_{data1}=V_{data2}$, and the present disclosure takes $V_{data1}=V_{data2}$ as an example to describe the embodiments of the present disclosure in detail.

In summary, in the embodiments of the present disclosure, because the second capacitor C2 can store the data voltage $V_{data1}$, under control of the compensation control signal VG2, the time during which the compensation transistor M4 is turned on can be extended, thereby extending the compensation time to achieve the purpose of sufficient compensation. In addition, the scanning control signal VG1 and the compensation control signal VG2 are two independent signals, and the compensation process is independent of the data writing process, that is, the compensation time is irrelevant to the refresh rate and resolution of the display panel.

For example, as illustrated in FIG. 2A, the pixel circuit 100 further comprises a light emitting control circuit 15. The light emitting control circuit 15 is connected to the light emitting driving circuit 13 and the light emitting element EL, respectively, and is configured to be turned on or turned off under control of a light emitting control signal, thereby controlling whether or not the current flows through the light emitting driving circuit 13 to drive the light emitting element EL to emit light.

For example, as illustrated in FIG. 2A, the light emitting control circuit 15 may comprise a first light emitting control transistor M6. The first light emitting control transistor M6 is disposed between the second power supply terminal V2 and the light emitting driving circuit 13, and is configured to control the connection between the second power supply terminal V2 and the light emitting driving circuit 13 to be turned on or turned off.

For example, the light emitting control signal comprises a first light emitting control sub-signal $V_{EM1}$. As illustrated in FIG. 2A, a first electrode of the first light emitting control transistor M6 is connected to the second power supply terminal V2, a second electrode of the first light emitting control transistor M6 is connected to the first electrode of the driving transistor M1 (i.e., the first node S), and a control electrode of the first light emitting control transistor M6 is configured to receive the first light emitting control sub-signal $V_{EM1}$. For example, the control electrode of the first light emitting control transistor M6 is configured to be connected to a first light emitting control signal line EM1 to receive the first light emitting control sub-signal $V_{EM1}$.

It should be noted that, in the example illustrated in FIG. 2A, the first electrode of the first light emitting control transistor M6 can be connected to a separate power supply terminal (the second power supply terminal V2), that is, the first electrode of the first light emitting control transistor M6 and the first terminal of the second capacitor C2 are respectively connected to different power supply terminals. However, the embodiments of the present disclosure are not limited thereto. The first electrode of the first light emitting control transistor M6 can also be connected to the first power supply terminal V1, that is, the first electrode of the first light emitting control transistor M6 and the first terminal of the second capacitor C2 are both connected to the same first power supply terminal V1.

For example, as illustrated in FIG. 2A, the light emitting control circuit 15 may further comprise a second light emitting control transistor M7. The second light emitting control transistor M7 is disposed between the light emitting driving circuit 13 and the light emitting element EL, and is configured to control the connection between the light emitting driving circuit 13 and the light emitting element EL to be turned on or turned off.

For example, the light emitting control signal further comprises a second light emitting control sub-signal $V_{EM2}$. As illustrated in FIG. 2A, a first electrode of the second light emitting control transistor M7 is connected to the second electrode of the driving transistor M1 (i.e., the second node D), a second electrode of the second light emitting control transistor M7 is connected to a first terminal of the light emitting element EL, a control electrode of the second light emitting control transistor M7 is configured to receive the second light emitting control sub-signal $V_{EM2}$. For example, the control electrode of the second light emitting control transistor M7 is configured to be connected to a second light emitting control signal line EM2 to receive the second light emitting control sub-signal $V_{EM2}$. A second terminal of the light emitting element EL is connected to a third power supply terminal V3.

For example, the first terminal of the light emitting element EL may be an anode, and the second terminal of the light emitting element EL may be a cathode.

For example, the first light emitting control sub-signal $V_{EM1}$ provided by the first light emitting control signal line EM1 and the second light emitting control sub-signal $V_{EM2}$ provided by the second light emitting control signal line EM2 may be identical.

It should be noted that, in the example illustrated in FIG. 2A, the control electrode of the first light emitting control transistor M6 and the control electrode of the second light emitting control transistor M7 can be connected to different light emitting control signal lines to receive different light emitting control signals. However, the embodiments of the present disclosure are not limited thereto, and the control electrode of the first light emitting control transistor M6 and the control electrode of the second light emitting control transistor M7 can also be electrically connected to the same light emitting control signal line, such as the first light emitting control signal line EM1, to receive the same first light emitting control sub-signal $V_{EM1}$. The present disclosure is not limited thereto.

For example, the third power supply terminal V3 may also be a DC voltage terminal to output a constant DC voltage. The third power supply terminal V3 may be a low voltage terminal. For example, in some examples, the third power supply terminal V3 may also be grounded.

For example, the first voltage signal output from the first power supply terminal V1 and a third voltage signal output from the third power supply terminal V3 may be identical, that is, the first power supply terminal V1 and the third power supply terminal V3 may be the same power supply terminal, so as to decrease the number of power supply terminals in the pixel circuit and save production costs.

It should be noted that the second voltage signal output from the second power supply terminal V2 and the third voltage signal output from the third power supply terminal V3 are different.

For example, as illustrated in FIG. 2A, the pixel circuit 100 may further comprise a first reset circuit 16. The first reset circuit 16 is connected to the control terminal of the light emitting driving circuit 13 and a reset signal terminal VINT, and is configured to reset the control terminal of the light emitting driving circuit 13 under control of a first reset control signal VRT1.

For example, as illustrated in FIG. 2A, the first reset circuit 16 may comprise a first reset transistor M3. A first electrode of the first reset transistor M3 is connected to the reset signal terminal VINT to receive a reset signal, a second electrode of the first reset transistor M3 is connected to the control terminal of the light emitting driving circuit 13 (i.e., the third node G), and a control electrode of the first reset transistor M3 is configured to be connected to a first reset control signal line RT1 to receive the first reset control signal VRT1.

For example, as illustrated in FIG. 2A, the pixel circuit 100 may further comprise a second reset circuit 17. The second reset circuit 17 is connected to the first terminal of the light emitting element EL and the reset signal terminal VINT, and is configured to reset the first terminal of the light emitting element EL under control of a second reset control signal VRT2.

For example, as illustrated in FIG. 2A, the second reset circuit 17 comprises a second reset transistor M5. A first electrode of the second reset transistor M5 is connected to the reset signal terminal VINT to receive the reset signal, a second electrode of the second reset transistor M5 is connected to the first terminal of the light emitting element EL, and a control electrode of the second reset transistor M5 is configured to be connected to a second reset control signal line RT2 to receive the second reset control signal VRT2.

For example, the compensation control signal VG2 may be a separate signal, width of which can be adjusted, but the embodiments of the present disclosure are not limited thereto, and the compensation control signal VG2 may also adopt other control signals in the pixel circuit 100. Because the reset phase does not conflict with the compensation phase, the second reset control signal VRT2 can be used as the compensation control signal VG2, that is, the compensation control signal G2 and the second reset control signal VRT2 can be the same signal, and the second reset control signal VRT2 is multiplexed as the compensation control signal VG2. For example, the control electrode of the second reset transistor M5 and the control electrode of the compensation transistor M4 are both configured to be connected to the second reset control signal line RT2 to receive the second reset control signal VRT2. Therefore, the pixel circuit may not be provided with the compensation control signal line G2, so as to decrease the number of signal lines.

For example, the first voltage signal output from the first power supply terminal V1 and the reset signal output from the reset signal terminal VINT are identical, that is, the first power supply terminal V1 and the reset signal terminal VINT may be the same power supply terminal.

For example, in the example illustrated in FIG. 2A, the first electrode of the first reset transistor M3 and the first electrode of the second reset transistor M5 are both connected to the same reset signal terminal VINT, but the embodiments of the present disclosure are not limited thereto, and the first electrode of the first reset transistor M3 and the first electrode of the second reset transistor M5 may also be connected to different reset signal terminals, as long as the first reset transistor M3 and the second reset transistor M5 can respectively implement corresponding reset functions, which is not limited in the present disclosure.

It should be noted that, according to actual application requirements, the pixel circuit 100 can also compensate the IR drop on the power supply lines. The specific structures of circuits such as the data writing circuit 12, the compensation circuit 14, the light emitting control circuit 15, the first reset circuit 16, and the second reset circuit 17 can be set according to actual application requirements, and the embodiments of the present disclosure do not specifically limit the structure of the circuits in the pixel circuit.

Figure 2B:
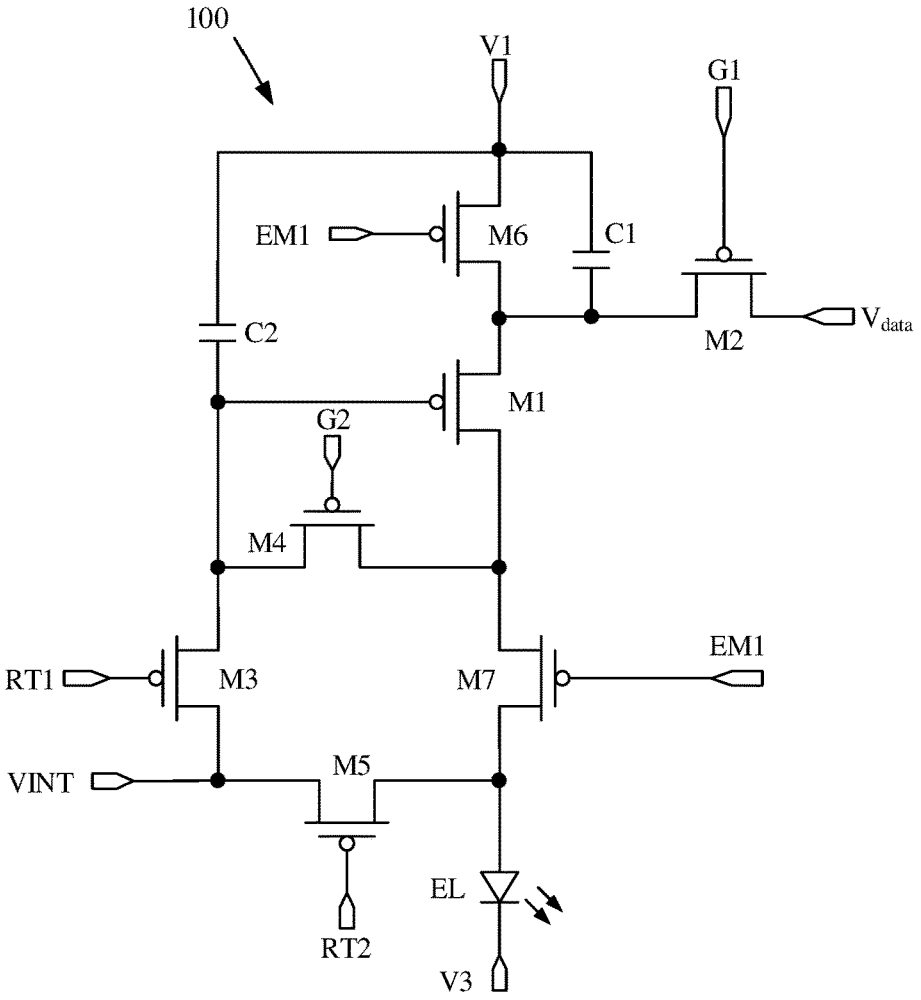
FIG. 2B is a structural schematic diagram of another pixel circuit provided by some embodiments of the present disclosure.

FIG. 2B is a structural schematic diagram of another pixel circuit provided by some embodiments of the present disclosure. For example, as illustrated in FIG. 2B, another pixel circuit 100 according to an embodiment of the present disclosure comprises a first capacitor C1, a second capacitor C2, a driving transistor M1, a data writing transistor M2, a compensation transistor M4, a first light emitting control transistor M6, a second light emitting control transistor M7, a first reset transistor M3, and a second reset transistor M5.

For example, as illustrated in FIG. 2B, a first electrode of the data writing transistor M2 is configured to receive a data voltage $V_{data1}$, a second electrode of the data writing transistor M2 is connected to a second terminal of the first capacitor C1, and a control electrode of the data writing transistor M2 is configured to be connected to a gate line G1 to receive a scanning control signal VG1. A first terminal of the first capacitor C1 is connected to a first power supply terminal V1, so that the first capacitor C1 is configured to store a stored data voltage $V_{data2}$ written by the data writing transistor M2.

For example, as illustrated in FIG. 2B, a first electrode of the driving transistor M1 is connected to the second electrode of the data writing transistor M2 and the second terminal of the first capacitor C1, a second electrode of the driving transistor M1 is connected to a first electrode of the compensation transistor M4, and a control electrode of the driving transistor M1 is connected to a second electrode of the compensation transistor M4. A control electrode of the compensation transistor M4 is configured to be connected to a compensation control signal line G2 to receive a compensation control signal VG2.

For example, as illustrated in FIG. 2B, a first terminal of the second capacitor C2 is connected to the first power supply terminal V1, and a second terminal of the second capacitor C2 is connected to the control electrode of the driving transistor M1.

For example, as illustrated in FIG. 2B, a first electrode of the first light emitting control transistor M6 is connected to the first power supply terminal V1, a second electrode of the first light emitting control transistor M6 is connected to the first electrode of the driving transistor M1, and a control electrode of the first light emitting control transistor M6 is configured to be connected to a first light emitting control signal line EM1 to receive a first light emitting control sub-signal $V_{EM1}$. A first electrode of the second light emitting control transistor M7 is connected to the second electrode of the driving transistor M1, a second electrode of the second light emitting control transistor M7 is connected to a first terminal of a light emitting element EL, and a control electrode of the second light emitting control transistor M7 is configured to be connected to the first light emitting control signal line EM1 to receive the first light emitting control sub-signal $V_{EM1}$. A second terminal of the light emitting element EL is connected to a third power supply terminal V3.

For example, as illustrated in FIG. 2B, a first electrode of the first reset transistor M3 is connected to a reset signal terminal VINT, a second electrode of the first reset transistor M3 is connected to the control electrode of the driving transistor M1, and a control electrode of the first reset transistor M3 is configured to be connected to a first reset control signal line RT1 to receive a first reset control signal VRT1. A first electrode of the second reset transistor M5 is connected to the reset signal terminal VINT, a second electrode of the second reset transistor M5 is connected to the first terminal of the light emitting element EL, and a control electrode of the second reset transistor M5 is configured to be connected to a second reset control signal line RT2 to receive a second reset control signal VRT2.

It should be noted that, for the description of the light emitting element EL, the first capacitor C1, the second capacitor C2, the driving transistor M1, the data writing transistor M2, the compensation transistor M4, the first light emitting control transistor M6, the second light emitting control transistor M7, the first reset transistor M3, and the second reset transistor M5, reference can be made to related descriptions of the pixel circuit in the embodiment illustrated in FIG. 2A, and details are not repeated herein again.

Figure 3:
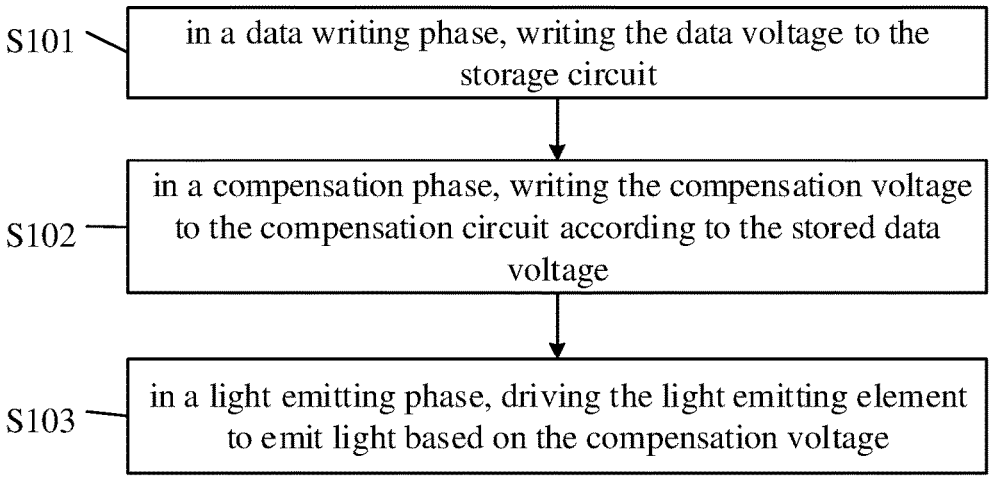
FIG. 3 is a schematic flowchart of a method for driving a pixel circuit provided by some embodiments of the present disclosure.

At least some embodiments of the present disclosure also provide a method for driving the pixel circuit according to any one of the above embodiments. FIG. 3 is a schematic flowchart of a method for driving a pixel circuit provided by some embodiments of the present disclosure. As illustrated in FIG. 3, the method may comprise following operations.

Step S101: in a data writing phase, writing the data voltage to the storage circuit;

Step S102: in a compensation phase, writing the compensation voltage to the compensation circuit according to the stored data voltage; and Step S103: in a light emitting phase, driving the light emitting element to emit light based on the compensation voltage.

In the method provided by the embodiments of the present disclosure, the data voltage is written into the storage circuit in the data writing phase, so that a compensation operation, based on the data voltage stored in the storage circuit, can be still performed in the compensation phase after the data writing phase. The compensation time is extended to achieve the purpose of sufficient compensation, and it can be achieved that the compensation time is independent of the refresh rate and resolution of the display panel, thereby improving the uniformity of the display brightness of the display panel and improving the display effect.

For example, in some embodiments, the method may further comprise: in a first reset phase, resetting the control terminal of the light emitting driving circuit; and in a second reset phase, resetting the first terminal of the light emitting element.

For example, the timing diagram of the pixel circuit can be set according to actual needs, which is not specifically limited in the embodiments of the present disclosure.

Figure 4A:
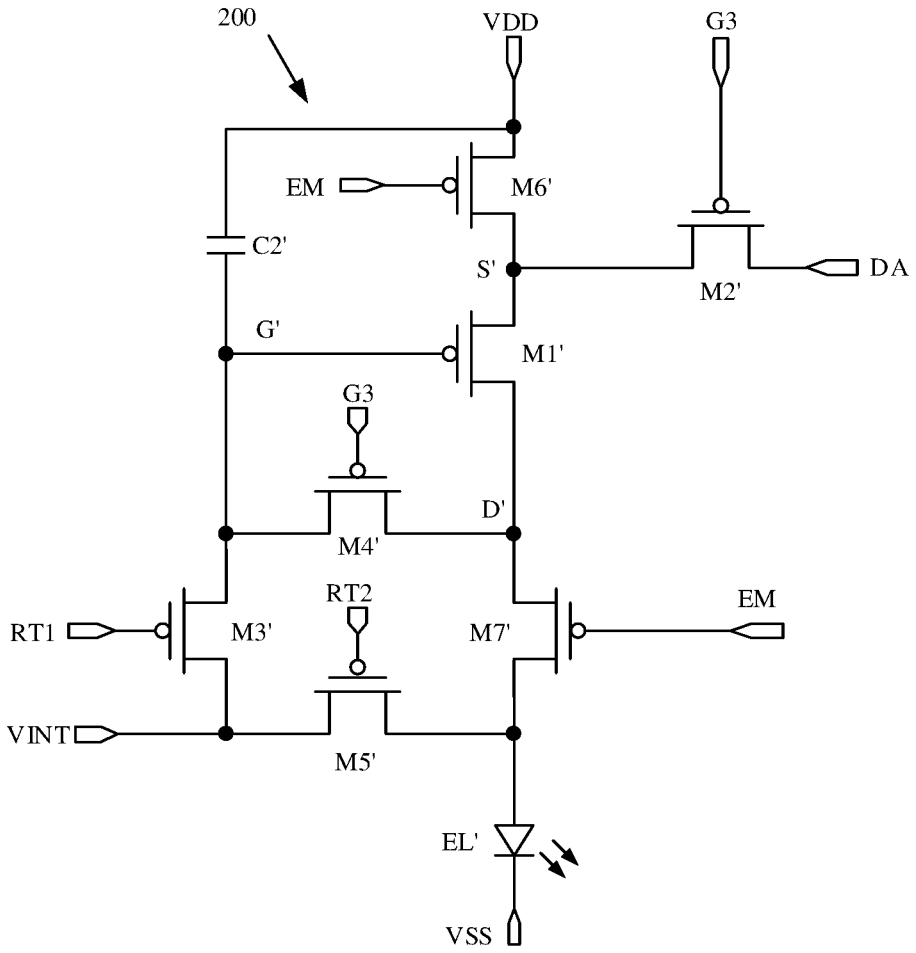
FIG. 4A is a structural schematic diagram of a pixel circuit.
Figure 4B:
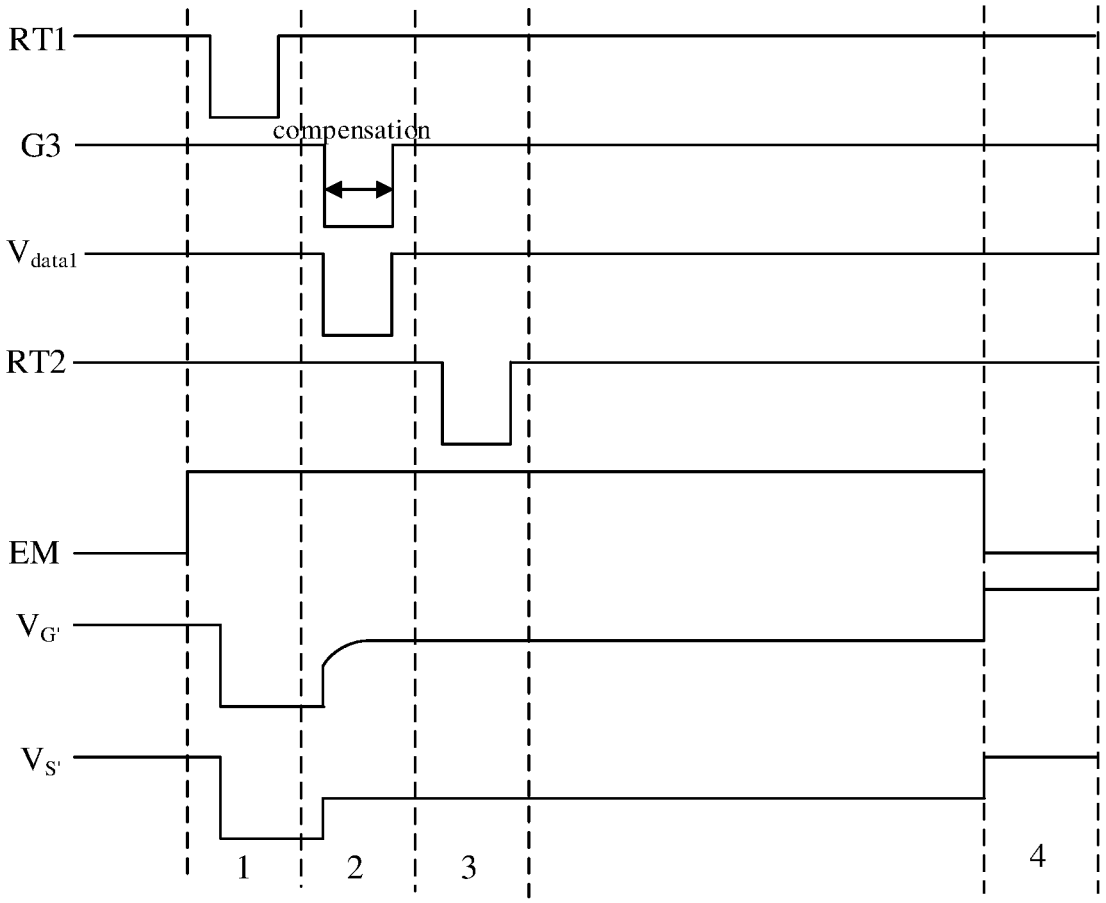
FIG. 4B is a timing diagram of a method for driving the pixel circuit illustrated in FIG. 4A.
Figure 5:
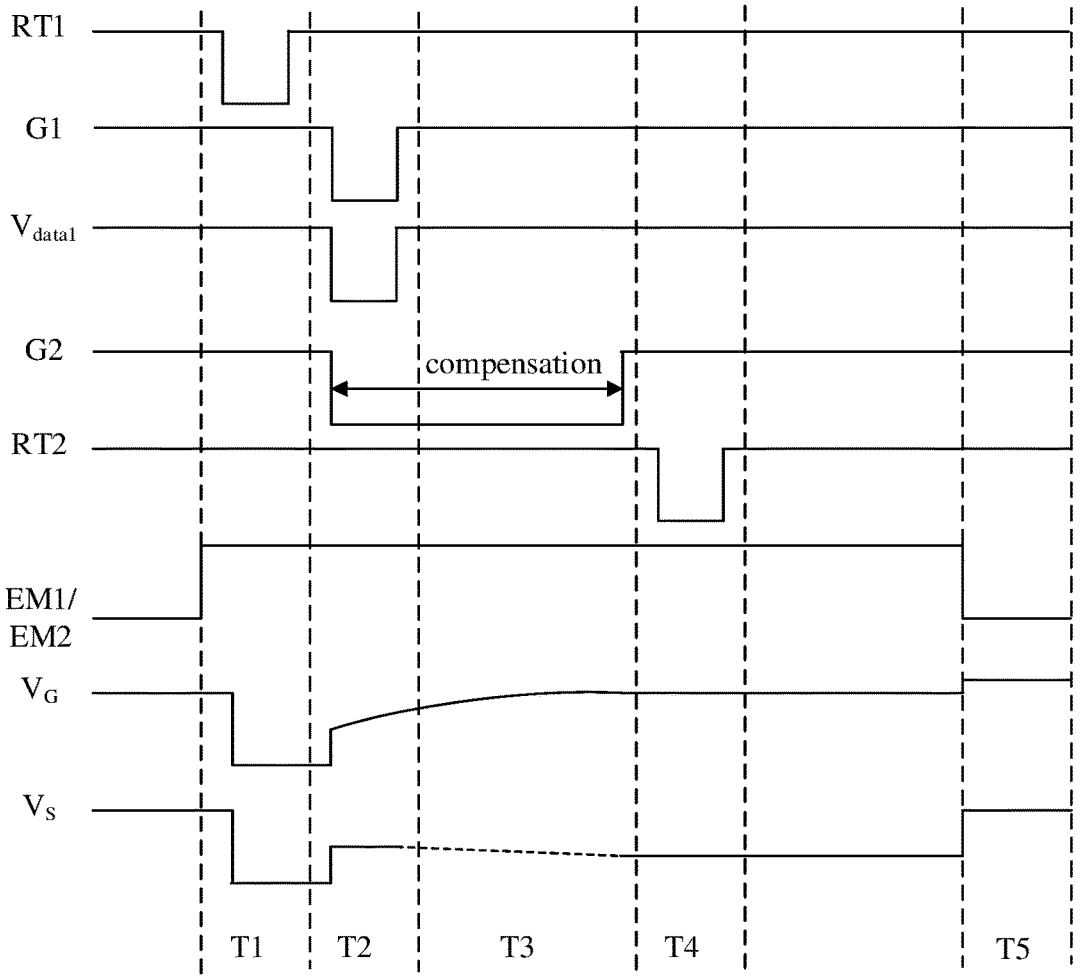
FIG. 5 is an exemplary timing diagram of a method for driving a pixel circuit provided by some embodiments of the present disclosure.

FIG. 4A is a structural schematic diagram of a pixel circuit, FIG. 4B is a timing diagram of a method for driving the pixel circuit illustrated in FIG. 4A, and FIG. 5 is an exemplary timing diagram of a method for driving a pixel circuit provided by some embodiments of the present disclosure.

For example, as illustrated in FIG. 4A, a pixel circuit 200 of a 7T1C type may comprise a data writing transistor M2', a driving transistor M1', a compensation transistor M4', a second capacitor CT, a first reset transistor M3', a second reset transistor M5', a first light emitting control transistor M6', and a second light emitting control transistor MT. The pixel circuit 200 is used to drive a light emitting element EL' to emit light.

For example, as illustrated in FIG. 4A and FIG. 4B, in a first reset phase 1, a first reset control signal VRT1 provided by a first reset control signal line RT1 is a low level signal (i.e., a valid signal). A scanning control signal VG3 provided by a scanning control signal line G3, a second reset control signal VRT2 provided by a second reset control signal line RT2, and a light emitting control signal $V_{EM}$ provided by a light emitting control signal line EM are all high level signals, so that the first reset transistor M3' is turned on, and the data writing transistor M2', the driving transistor M1', the compensation transistor M4', the second reset transistor M5', the first light emitting control transistor M6', and the second light emitting control transistor MT are all turned off. A reset signal output from a reset signal terminal VINT can be written into a control electrode of the driving transistor M1' via the first reset transistor M3', so as to reset the control electrode of the driving transistor Mr. Thus, in a previous frame, the voltage held on the control electrode of the driving transistor M1' is cleared, a voltage $V_{G'}$ on the control electrode of the driving transistor M1' and a voltage $V_S$, on a First Electrode of the Driving Transistor M1' Both are Reset to Low Level Signals.

For example, as illustrated in FIG. 4A and FIG. 4B, in a data writing and compensation phase 2, the scanning control signal VG3 is a low level signal (i.e., a valid signal), the first reset signal VRT1, the second reset signal VRT2, and the light emitting control signal $V_{EM}$ are all high level signals. Thus, the data writing transistor M2', the driving transistor M1', and the compensation transistor M4' are all turned on, and the first reset transistor M3', the second reset transistor M5', the first light emitting control transistor M6', and the second light emitting control transistor MT are all turned off. Because the data writing transistor M2', the driving transistor M1', and the compensation transistor M4' are all turned on, a data voltage $V_{data1}$ is written into the control electrode of the driving transistor M1' (i.e., a node G') via the data writing transistor M2', the driving transistor M1', and the compensation transistor M4' successively, if the compensation time is sufficient, a voltage of the control electrode of the driving transistor M1' finally may be $V_{data1}$+Vth', and Vth' is a threshold voltage of the driving transistor Mr. However, because the duration during which the data writing and compensation phase 2 are turned on is short, when the data writing and compensation phase 2 ends, the voltage $V_{G'}$ of the control electrode of the driving transistor M1' cannot reach $V_{data1}$+Vth', that is, $V_{G'}<V_{data1}$+Vth'. As illustrated in FIG. 4B, in the method for driving the pixel circuit 200, the time of the compensation process is the same as the time when the scanning control signal VG3 is a low level signal.

For example, as illustrated in FIG. 4A and FIG. 4B, in a second reset phase 3, the second reset signal VRT2 is a low level signal (i.e., a valid signal), and the first reset signal VRT1, the scanning control signal VG3, and the light emitting control signal $V_{EM}$ are all high level signals. Therefore, the second reset transistor M5' is turned on, and the remaining transistors are turned off. The reset signal output from the reset signal terminal VINT can be written into a first terminal of the light emitting element EL' via the second reset transistor M5', so as to reset the first terminal of the light emitting element EL', and at this time, the light emitting element EL' does not emit light.

For example, as illustrated in FIG. 4A and FIG. 4B, in a light emitting phase 4, the light emitting control signal $V_{EM}$ is a low level signal (i.e., a valid signal), and the first reset signal VRT1, the scanning control signal VG3, and the second reset signal VRT2 are all high level signals. Therefore, the data writing transistor M2', the compensation transistor M4', the first reset transistor M3', and the second reset transistor M5' are all turned off, and the first light emitting control transistor M6' and the second light emitting control transistor M7' are both turned on. A voltage $V_S$ on the first electrode of the driving transistor M1' rises to a high voltage $V_d$ output from a power supply voltage terminal VDD, and the voltage $V_{G'}$ on the control electrode of the driving transistor M1' can control the driving transistor M1' to be in a saturation state. According to the saturation current formula of the driving transistor M1', a light emitting current $I_1$ flowing through the driving transistor M1' can be expressed as follows.

$$I_1=K*(V_{GS}-Vth')^2=K*(V_G-V_d-Vth')^2$$

In the above formula, $V_{GS}$ is a voltage difference between a gate electrode (i.e., the control electrode) of the driving transistor M1' and a source electrode (i.e., the first electrode) of the driving transistor Mr. Because $V_{G'}<V_{data1}$+Vth' and $V_{G'}-V_d-Vth'<V_{data1}-V_d$, the light emitted by the light emitting element EL' does not match the data voltage $V_{data1}$ which is written, thereby causing the phenomenon of non-uniformity display of the display panel.

The operation process of the method for driving the pixel circuit provided by the embodiments of the present disclosure is described in detail below with reference to FIG. 2A and FIG. 5.

For example, as illustrated in FIG. 2A and FIG. 5, in a first reset phase T1, the first reset control signal VRT1 provided by the first reset control signal line RT1 is a low level signal (i.e., a valid signal), and the scanning control signal VG1 provided by the gate line G1, the compensation control signal VG2 provided by the compensation control signal line G2, the second reset signal VRT2 provided by the second reset control signal line RT2, the first light emitting control sub-signal $V_{EM1}$ provided by the first light emitting control signal line EM1, and the second light emitting control sub-signal $V_{EM2}$ provided by the second light emitting control signal line EM2 are all high level signals, so that the first reset transistor M3 is turned on, and the data writing transistor M2, the driving transistor M1, the compensation transistor M4, the second reset transistor M5, the first light emitting control transistor M6, and the second light emitting control transistor M7 are all turned off. The reset signal (e.g., a low voltage signal) output from the reset signal terminal VINT can be written into the control electrode of the driving transistor M1, so as to reset the control electrode of the driving transistor M1. Therefore, in the previous frame, the voltage held on the control electrode of the driving transistor M1 is cleared, and a voltage $V_G$ of the control electrode of the driving transistor M1 and a voltage $V_S$ of the first electrode of the driving transistor M1 are both reset to low level signals.

For example, as illustrated in FIG. 2A and FIG. 5, in a data writing phase T2 (e.g., a first compensation phase), the scanning control signal VG1 and the compensation control signal VG2 may both be low level signals (i.e., valid signals). The first reset signal VRT1, the second reset signal VRT2, the first light emitting control sub-signal $V_{EM1}$, and the second light emitting control sub-signal $V_{EM2}$ are all high level signals. Therefore, the data writing transistor M2, the driving transistor M1, and the compensation transistor M4 are all turned on, and the first reset transistor M3, the second reset transistor M5, the first light emitting control transistor M6, and the second light emitting control transistor M7 are all turned off. The data voltage $V_{data1}$ is written into the second terminal of the first capacitor C1 (i.e., the first electrode of the driving transistor M1) via the data writing transistor M2. The first capacitor C1 can store the stored data voltage $V_{data2}$ (i.e., the data voltage $V_{data1}$). The voltage $V_S$ of the first electrode of the driving transistor M1 may be the stored data voltage $V_{data2}$. Because the compensation transistor M4 is turned on, the driving transistor M1 forms a diode connection, and the driving transistor M1 is also turned on, so that the data voltage $V_{data1}$ can also be written into the control electrode of the driving transistor M1 (i.e., the third node G) through the driving transistor M1 and the compensation transistor M4 successively, and the voltage $V_G$ of the control electrode of the driving transistor M1 gradually rises, thereby starting the compensation operation.

For example, as illustrated in FIG. 2A and FIG. 5, in a compensation phase T3 (e.g., a second compensation phase), the compensation control signal VG2 remains as a low level signal (i.e., a valid signal), the scanning control signal VG1 becomes a high level signal (i.e., an invalid signal), and the first reset signal VRT1, the second reset signal VRT2, the first light emitting control sub-signal $V_{EM1}$, the second light emitting control sub-signal $V_{EM2}$ also all remain as high level signals. Thus, the driving transistor M1 and the compensation transistor M4 are still turned on, the data writing transistor M2 is turned off, and the first reset transistor M3, the second reset transistor M5, the first light emitting control transistor M6, and the second light emitting control transistor M7 are also turned off. Because the stored data voltage $V_{data2}$ is stored in the first capacitor C1, the stored data voltage $V_{data2}$ can still be written into the second capacitor C2 via the driving transistor M1 and the compensation transistor M4 successively, so as to continue the compensation operation. In this case, the voltage $V_S$ of the first electrode of the driving transistor M1 gradually decreases, and the voltage $V_G$ of the control electrode of the driving transistor M1 still gradually increases. Because the compensation phase T3 can be enough long time, finally, a voltage difference $V_{GS}$ between the first electrode of the driving transistor M1 and the control electrode of the driving transistor M1 is equal to a threshold voltage Vth of the driving transistor M1, that is, $V_{GS}$=Vth, in this case, the driving transistor M1 is turned off and the compensation phase T3 ends. Because the capacitance value of the first capacitor C1 is much larger than the capacitance value of the second capacitor C2, the reduction amount of the voltage $V_S$ of the first electrode of the driving transistor M1 is small in the compensation process during the compensation phase T3, and thus, when the compensation phase T3 ends, the voltage $V_S$ of the first electrode of the driving transistor M1 is approximately equal to the stored data voltage $V_{data2}$. That is, when the compensation phase T3 ends, the voltage $V_S$ of the first electrode of the driving transistor M1 is approximately equal to the stored data voltage $V_{data2}$, and the voltage $V_G$ of the control electrode of the driving transistor M1 is approximately $V_{data2}$+Vth. In a case where the capacitance value of the first capacitor C1 is much larger than the capacitance value of the second capacitor C2, the reduction amount of the voltage of the first electrode of the driving transistor M1 can be ignored in the compensation phase T3, that is, when the compensation phase T3 ends, the voltage $V_S$ of the first electrode of the transistor M1 is $V_S$=$V_{data2}$ (i.e., $V_{data1}$), and the voltage $V_G$ of the control electrode of the driving transistor M1 is $V_G$=$V_{data2}$+Vth.

For example, as illustrated in FIG. 5, in the method for driving the pixel circuit, the time of the compensation process includes the time of the data writing phase T2 and the time of the compensation phase T3.

For example, as illustrated in FIG. 5, the time during which the scanning control signal VG1 is a low level signal is the same as the time when the data voltage $V_{data1}$ is provided, and the time during which the compensation control signal VG2 is a low level signal is independent of the time when the data voltage $V_{data1}$ is provided. By adjusting the time during which the compensation control signal VG2 is a valid signal, the first capacitor C1 is used to temporarily store the data voltage $V_{data1}$, so that the compensation time can be indirectly extended, and pixel driving with high resolution and high refresh rate can be achieved with a small cost.

For example, as illustrated in FIG. 5, a duration of the data writing phase T2 (the first compensation phase) is shorter than a duration of the compensation phase T3 (the second compensation phase), that is, the method provided by the embodiments of the present disclosure can extend the compensation time to achieve the purpose of sufficient compensation.

It should be noted that, because the data voltage $V_{data1}$ can be written into the control electrode of the driving transistor M1 in the data writing phase T2, the compensation operation starts at the data writing phase T2; and in the compensation phase T3, the data voltage $V_{data1}$ can still be written into the control electrode of the driving transistor M1 to continue the compensation operation. Therefore, in the embodiments of the present disclosure, the compensation of the threshold voltage may include the first compensation phase (the data writing phase T2) and the second compensation phase (the compensation phase T3).

For example, as illustrated in FIG. 2A and FIG. 5, in a second reset phase T4, the second reset signal VRT2 is a low level signal (i.e., a valid signal), and the first reset signal VRT1, the scanning control signal VG1, the compensation control signal VG2, the first light emitting control sub-signal $V_{EM1}$, and the second light emitting control sub-signal $V_{EM2}$ are all high level signals. Therefore, the second reset transistor M5 is turned on, and the remaining transistors are turned off. The reset signal output from the reset signal terminal VINT can be written into the first terminal of the light emitting element EL, so as to reset the first terminal of the light emitting element EL. At this time, the light emitting element EL does not emit light.

For example, as illustrated in FIG. 2A and FIG. 5, in a light emitting phase T5, the first light emitting control sub-signal $V_{EM1}$ and the second light emitting control sub-signal $V_{EM2}$ are both low level signals (i.e., valid signals), and the scanning control signal VG1, the compensation control signal VG2, the first reset signal VRT1, the second reset signal VRT2 are all high level signals. Therefore, the data writing transistor M2, the compensation transistor M4, the first reset transistor M3, and the second reset transistor M5 are all turned off, and the first light emitting control transistor M6 and the second light emitting control transistor M7 are both turned on. The voltage $V_S$ of the first electrode of the driving transistor M1 rises to a second voltage signal $V_{d2}$ output from the second power supply terminal V2. The voltage $V_G$ of the control electrode of the driving transistor M1 can control the driving transistor M1 to be in a saturation state. According to the saturation current formula of the driving transistor M1, a light emitting current $I_{EL}$ flowing through the driving transistor M1 can be expressed as follows.

$$\begin{aligned} I_{EL} &= K*(V_{GS}-Vth)^2 \\ &= K*[(V_{data2}+Vth-V_{d2})-Vth]^2 \\ &= K*(V_{data2}-V_{d2})^2 \end{aligned}$$

In the above formula, $V_{GS}$ is a voltage difference between a gate electrode of the driving transistor M1 and a source electrode of the driving transistor M1, and Vth is a threshold voltage of the driving transistor M1. It can be seen from the above formula that the light emitting current $T_{EL}$ is no longer affected by the threshold voltage Vth of the driving transistor M1, but is only related to the second voltage signal $V_{d2}$ output from the second power supply terminal V2 and the stored data voltage $V_{data2}$ (i.e., the data voltage $V_{data1}$). The stored data voltage $V_{data2}$ is directly transmitted by a data voltage line, and is independent of the threshold voltage Vth of the driving transistor M1. In this way, the problem of the threshold voltage drift of the driving transistor M1 due to the manufacturing process and long-term operation can be solved. In summary, the pixel circuit provided by the embodiments of the present disclosure can ensure the accuracy of the light emitting current $I_{EL}$, eliminate the influence of the threshold voltage of the driving transistor M1 on the light emitting current $I_{EL}$, ensure that the light emitting element EL operates normally, improve the uniformity of the display image, and improve the display effect.

For example, K is a constant in the above formula, and K can be expressed as follows.

$$K=0.5*\mu_p*C_{ox}*(W/L)$$

Here, $\mu_p$ is an electron mobility of the driving transistor M1, $C_{ox}$ is a gate unit capacitance of the driving transistor M1, W is a channel width of the driving transistor M1, and L is a channel length of the driving transistor M1.

It should be noted that the setting modes of the first reset phase, the second reset phase, the compensation phase, the data writing phase, and the light emitting phase can be determined according to actual application requirements, and are not specifically limited in the embodiments of the present disclosure.

Figure 6:
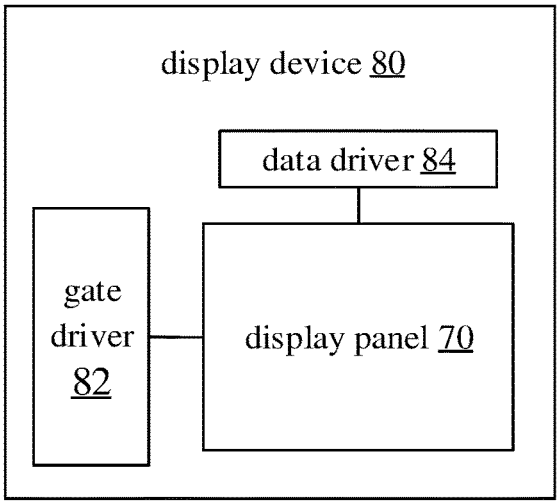
FIG. 6 is a schematic block diagram of a display device provided by some embodiments of the present disclosure.

Some embodiments of the present disclosure also provide a display device. FIG. 6 is a schematic block diagram of a display device provided by some embodiments of the present disclosure. As illustrated in FIG. 6, a display device 80 may comprise a display panel 70, and the display panel 70 is used for displaying an image. The display panel 70 comprises a plurality of pixel units, and the plurality of pixel units may be arranged in an array. Each pixel unit may comprise the pixel circuit 100 described in any one of the above embodiments. The pixel circuit 100 temporarily stores the data voltage by the storage circuit, so that the compensation operation can be still performed after the data writing phase, and the compensation time is extended to achieve the purpose of sufficient compensation. Therefore, it can be achieved that the compensation time is independent of the refresh rate and resolution of the display panel, the uniformity of the display brightness of the display panel is improved, and the display effect is improved.

For example, each pixel unit may further comprise the light emitting element according to any one of the above embodiments. In each pixel unit, the pixel circuit is configured to drive the light emitting element to emit light.

For example, the display panel 70 may be a rectangular panel, a circular panel, an elliptical panel, a polygonal panel, or the like. In addition, the display panel 70 may be not only a flat panel, but also a curved panel, or even a spherical panel.

For example, the display panel 70 may also have a touch function, that is, the display panel 70 may be a touch display panel.

For example, as illustrated in FIG. 6, the display device 80 may further comprise a gate driver 82. The gate driver 82 is configured to be electrically connected to the data writing circuit of the pixel circuit in the pixel unit through a gate line, so as to provide the scanning control signal to the data writing circuit. The gate driver 82 is also configured to be electrically connected to the compensation circuit of the pixel circuit in the pixel unit through a compensation control signal line, so as to provide the compensation control signal to the compensation circuit.

For example, as illustrated in FIG. 6, the display device 80 may further comprise a data driver 84. The data driver 84 is configured to be electrically connected to the data writing circuit of the pixel circuit in the pixel unit through a data line, so as to provide the data voltage to the data writing circuit.

For example, the gate driver 82 and the data driver 84 may be implemented by respective application specific integrated circuit chips, or may be directly manufactured on the display panel 70 through a semiconductor manufacturing process. For example, the gate driver 82 may comprise a gate drive circuit implemented as a gate driver on array (GOA).

For example, the display device 80 may be any product or component having a display function, such as a mobile phone, a tablet computer, a television, a display, a notebook computer, a digital photo frame, a navigator, and the like.

It should be noted that other components of the display device 80 (such as a control device, an image data encoding/decoding device, a clock circuit, and the like) should be understood by those of ordinary skill in the art, and are not repeated here, which should not be regarded as a limitation on the present disclosure.

The following statements should be noted.

(1) The accompanying drawings involve only the structure(s) in connection with the embodiment(s) of the present disclosure, and other structure(s) can be referred to common design(s).

(2) In case of no conflict, embodiments of the present disclosure and features in the embodiments can be combined to obtain new embodiments.

The above description merely is specific implementations of the present disclosure, the protection scope of the present disclosure is not limited thereto, and the protection scope of the present disclosure is determined by the protection scope defined by the claims.

What is claimed is:

1. A pixel circuit, comprising: a storage circuit, a data writing circuit, a light emitting driving circuit, and a compensation circuit, wherein the data writing circuit is connected to the storage circuit, and is configured to write a data voltage to the storage circuit under control of a scanning control signal;

the storage circuit is configured to store the data voltage and enable a stored data voltage to be available to the compensation circuit for a compensation operation;

the compensation circuit is connected to the light emitting driving circuit, and is configured to maintain a compensation voltage based on the stored data voltage at a control terminal of the light emitting driving circuit under control of a compensation control signal; and the light emitting driving circuit is further connected to a light emitting element, and is configured to drive the light emitting element to emit light under control of the compensation voltage, wherein the storage circuit comprises a first capacitor, a first terminal of the first capacitor is connected to a first power supply terminal, and a second terminal of the first capacitor is connected to the data writing circuit; and the light emitting driving circuit comprises a driving transistor, the control terminal of the light emitting driving circuit comprises a control electrode of the driving transistor, a first electrode of the driving transistor is connected to the data writing circuit and the second terminal of the first capacitor, and a second electrode of the driving transistor and the control electrode of the driving transistor are both connected to the compensation circuit.

2. The pixel circuit according to claim 1, wherein the data writing circuit comprises a data writing transistor, a first electrode of the data writing transistor is configured to receive the data voltage, a second electrode of the data writing transistor is connected to the second terminal of the first capacitor and the first electrode of the driving transistor, and a control electrode of the data writing transistor is configured to receive the scanning control signal.

3. The pixel circuit according to claim 1, wherein the compensation circuit comprises a compensation transistor and a second capacitor, a first electrode of the compensation transistor is connected to the second electrode of the driving transistor, a second electrode of the compensation transistor is connected to the control electrode of the driving transistor, and a control electrode of the compensation transistor is configured to receive the compensation control signal;

a first terminal of the second capacitor is connected to a second power supply terminal, and a second terminal of the second capacitor is connected to the control electrode of the driving transistor; and a capacitance value of the first capacitor is greater than a capacitance value of the second capacitor.

4. The pixel circuit according to claim 3, further comprising a light emitting control circuit, wherein the light emitting control circuit is connected to the light emitting driving circuit and the light emitting element, respectively, and is configured to control the light emitting driving circuit to drive the light emitting element to emit light under control of a light emitting control signal.

5. The pixel circuit according to claim 4, wherein the light emitting control circuit comprises a first light emitting control transistor, the light emitting control signal comprises a first light emitting control sub-signal, a first electrode of the first light emitting control transistor is connected to the second power supply terminal, a second electrode of the first light emitting control transistor is connected to the first electrode of the driving transistor, and a control electrode of the first light emitting control transistor is configured to receive the first light emitting control sub-signal.

6. The pixel circuit according to claim 5, wherein a first voltage signal output from the first power supply terminal and a second voltage signal output from the second power supply terminal are identical.

7. The pixel circuit according to claim 5, wherein the light emitting control circuit further comprises a second light emitting control transistor, the light emitting control signal comprises a second light emitting control sub-signal, a first electrode of the second light emitting control transistor is connected to the second electrode of the driving transistor, a second electrode of the second light emitting control transistor is connected to a first terminal of the light emitting element, a control electrode of the second light emitting control transistor is configured to receive the second light emitting control sub-signal, and a second terminal of the light emitting element is connected to a third power supply terminal.

8. The pixel circuit according to claim 7, wherein a first voltage signal output from the first power supply terminal and a third voltage signal output from the third power supply terminal are identical.

9. The pixel circuit according to claim 1, further comprising a first reset circuit, wherein the first reset circuit is connected to the control terminal of the light emitting driving circuit and a reset signal terminal, and is configured to reset the control terminal of the light emitting driving circuit under control of a first reset control signal.

10. The pixel circuit according to claim 1, further comprising a second reset circuit, wherein the second reset circuit is connected to a first terminal of the light emitting element and a reset signal terminal, and is configured to reset the first terminal of the light emitting element under control of a second reset control signal.

11. The pixel circuit according to claim 10, wherein the compensation control signal and the second reset control signal are a same signal.

12. The pixel circuit according to claim 9, wherein a first voltage signal output from the first power supply terminal and a reset signal output from the reset signal terminal are identical.

13. A pixel circuit, comprising: a first capacitor, a second capacitor, a driving transistor, a data writing transistor, a compensation transistor, a first light emitting control transistor, a second light emitting control transistor, a first reset transistor, and a second reset transistor, wherein a first electrode of the data writing transistor is configured to receive a data voltage, a second electrode of the data writing transistor is connected to a second terminal of the first capacitor, and a control electrode of the data writing transistor is configured to receive a scanning control signal;

a first terminal of the first capacitor is connected to a first power supply terminal, and the first capacitor is configured to store the data voltage written by the data writing transistor;

a first electrode of the driving transistor is connected to the second electrode of the data writing transistor and the second terminal of the first capacitor, a second electrode of the driving transistor is connected to a first electrode of the compensation transistor, and a control electrode of the driving transistor is connected to a second electrode of the compensation transistor;

a control electrode of the compensation transistor is configured to receive a compensation control signal;

a first terminal of the second capacitor is connected to the first power supply terminal, and a second terminal of the second capacitor is connected to the control electrode of the driving transistor;

a first electrode of the first light emitting control transistor is connected to the first power supply terminal, a second electrode of the first light emitting control transistor is connected to the first electrode of the driving transistor, and a control electrode of the first light emitting control transistor is configured to receive a first light emitting control sub-signal;

a first electrode of the second light emitting control transistor is connected to the second electrode of the driving transistor, a second electrode of the second light emitting control transistor is connected to a first terminal of a light emitting element, and a control electrode of the second light emitting control transistor is configured to receive the first light emitting control sub-signal;

a second terminal of the light emitting element is connected to a third power supply terminal;

a first electrode of the first reset transistor is connected to a reset signal terminal, a second electrode of the first reset transistor is connected to the control electrode of the driving transistor, and a control electrode of the first reset transistor is configured to receive a first reset control signal; and a first electrode of the second reset transistor is connected to the reset signal terminal, a second electrode of the second reset transistor is connected to the first terminal of the light emitting element, and a control electrode of the second reset transistor is configured to receive a second reset control signal.

14. A method for driving the pixel circuit according to claim 1, the method comprising:

in a data writing phase, writing the data voltage to the storage circuit;

in a compensation phase, writing the compensation voltage to the compensation circuit according to the stored data voltage; and in a light emitting phase, driving the light emitting element to emit light based on the compensation voltage.

15. The method according to claim 14, wherein a duration of the data writing phase is shorter than a duration of the compensation phase.

16. A display device, comprising the pixel circuit according to claim 1.

17. The display device according to claim 16, further comprising the light emitting element, wherein the pixel circuit is configured to drive the light emitting element to emit light.

18. The pixel circuit according to claim 2, wherein the compensation circuit comprises a compensation transistor and a second capacitor, a first electrode of the compensation transistor is connected to the second electrode of the driving transistor, a second electrode of the compensation transistor is connected to the control electrode of the driving transistor, and a control electrode of the compensation transistor is configured to receive the compensation control signal;

a first terminal of the second capacitor is connected to a second power supply terminal, and a second terminal of the second capacitor is connected to the control electrode of the driving transistor; and a capacitance value of the first capacitor is greater than a capacitance value of the second capacitor.

19. A pixel circuit, comprising: a storage circuit, a data writing circuit, a light emitting driving circuit, and a compensation circuit, wherein the data writing circuit is connected to the storage circuit, and is configured to write a data voltage to the storage circuit under control of a scanning control signal; the storage circuit is configured to store the data voltage and enable a stored data voltage to be available to the compensation circuit for a compensation operation; the compensation circuit is connected to the light emitting driving circuit, and is configured to maintain a compensation voltage based on the stored data voltage at a control terminal of the light emitting driving circuit under control of a compensation control signal; and the light emitting driving circuit is further connected to a light emitting element, and is configured to drive the light emitting element to emit light under control of the compensation voltage, wherein the storage circuit comprises a first capacitor, a first terminal of the first capacitor is connected to a first power supply terminal, and a second terminal of the first capacitor is connected to the data writing circuit; and the pixel circuit further comprises a first reset circuit and a second reset circuit, the first reset circuit is connected to the control terminal of the light emitting driving circuit and a reset signal terminal, and is configured to reset the control terminal of the light emitting driving circuit under control of a first reset control signal, the second reset circuit is connected to a first terminal of the light emitting element and the reset signal terminal, and is configured to reset the first terminal of the light emitting element under control of a second reset control signal, the compensation control signal and the second reset control signal are a same signal.

* * * * *